US009155942B2

(12) United States Patent
Ueda et al.

(10) Patent No.: US 9,155,942 B2
(45) Date of Patent: Oct. 13, 2015

(54) GOLF CLUB HEAD

(71) Applicant: DUNLOP SPORTS CO. LTD., Kobe-shi, Hyogo (JP)

(72) Inventors: Naoyoshi Ueda, Kobe (JP); Naruhiro Mizutani, Kobe (JP)

(73) Assignee: DUNLOP SPORTS CO., LTD., Kobe-Shi (JP)

( * ) Notice: Subject to any disclaimer, the term of this patent is extended or adjusted under 35 U.S.C. 154(b) by 101 days.

(21) Appl. No.: 13/763,807

(22) Filed: Feb. 11, 2013

(65) Prior Publication Data

US 2013/0225314 A1 Aug. 29, 2013

(30) Foreign Application Priority Data

Feb. 29, 2012 (JP) ..... 2012-042619

(51) Int. Cl.

*A63B 53/04* (2015.01)
*A63B 53/02* (2015.01)
*A63B 59/00* (2015.01)

(52) U.S. Cl.

CPC ..... *A63B 53/02* (2013.01); *A63B 53/047* (2013.01); *A63B 53/0466* (2013.01); *A63B 53/0487* (2013.01); *A63B 59/0088* (2013.01); *A63B 2053/042* (2013.01); *A63B 2053/0408* (2013.01); *A63B 2053/0433* (2013.01); *A63B 2053/0491* (2013.01)

(58) Field of Classification Search

CPC .. A63B 53/02; A63B 53/047; A63B 59/0088; A63B 2053/0433; A63B 2053/0408; A63B 2053/0491; A63B 53/0487; A63B 53/0466; A63B 2053/042

USPC ..... 473/244–248, 305–315, 345, 349, 350

See application file for complete search history.

(56) References Cited

U.S. PATENT DOCUMENTS

| | | | | | |
|---|---|---|---|---|---|
| 1,206,104 | A * | 11/1916 | Goodrich | 473/245 |
| 2,962,286 | A * | 11/1960 | Brouwer | 473/247 |
| 5,769,307 | A * | 6/1998 | Takeda | 228/112.1 |
| 5,885,170 | A * | 3/1999 | Takeda | 473/306 |
| 6,095,931 | A * | 8/2000 | Hettinger et al. | 473/341 |
| 6,561,921 | B2 * | 5/2003 | Takeda | 473/305 |
| 6,923,733 | B2 * | 8/2005 | Chen | 473/305 |
| 7,066,516 | B2 * | 6/2006 | Mulvihill et al. | 296/24.4 |
| 7,090,590 | B2 * | 8/2006 | Chen | 473/324 |
| 7,247,811 | B2 * | 7/2007 | Chen et al. | 219/121.46 |
| 7,887,431 | B2 * | 2/2011 | Beach et al. | 473/307 |
| 8,083,607 | B2 * | 12/2011 | Clausen et al. | 473/291 |
| 8,206,237 | B2 * | 6/2012 | Gilbert et al. | 473/309 |
| 8,434,671 | B1 * | 5/2013 | Su | 228/228 |
| 2002/0034984 | A1 | 3/2002 | Takeda | |
| 2002/0107087 | A1 * | 8/2002 | Fagot | 473/291 |

(Continued)

*Primary Examiner* — Stephen Blau

(74) *Attorney, Agent, or Firm* — Birch, Stewart, Kolasch & Birch, LLP

(57) ABSTRACT

A head 2 includes a head body h1 and a neck part n1. The head body h1 and the neck part n1 are joined. The head body h1 has a body side joint surface s1 and a first recessed part opened in the body side joint surface s1. A space v1 is formed by the first recessed part r1. The neck part n1 has a neck side joint surface brought into surface contact with the body side joint surface s1 and a shaft hole 14. An abutted boundary surface Pt passes through a vicinity ad1 of a head height lowest point. When a plane perpendicular to an axis line z of the shaft hole 14 is defined as PL, and an angle between the plane PL and the abutted boundary surface Pt is θ degree, the angle θ is a plus value.

18 Claims, 6 Drawing Sheets

(56) References Cited

U.S. PATENT DOCUMENTS

| | | | | |
|---|---|---|---|---|
| 2005/0192115 | A1* | 9/2005 | Huang et al. | 473/305 |
| 2006/0100033 | A1* | 5/2006 | Nelson et al. | 473/349 |
| 2009/0029791 | A1* | 1/2009 | Solheim | 473/291 |
| 2009/0111604 | A1 | 4/2009 | Tsai et al. | |
| 2009/0270197 | A1* | 10/2009 | Holtzman | 473/296 |
| 2013/0190103 | A1* | 7/2013 | Rice et al. | 473/334 |

* cited by examiner

GOLF CLUB HEAD

The present application claims priority on Patent Application No. 2012-042619 filed in JAPAN on Feb. 29, 2012, the entire contents of which are hereby incorporated by reference.

BACKGROUND OF THE INVENTION

1. Field of the Invention

The present invention relates to a golf club head.

2. Description of the Related Art

A golf club head obtained by joining two members has been known. Japanese Patent Application Laid-Open No. 2002-165908 (US2002/0034984) discloses a head obtained by joining a hosel base part and a hosel body. In the head, a hollow part is formed in a hosel or a heel. Japanese Utility Model Application Publication No. 3142188 (US2009/0111604) discloses a head obtained by joining a body made of a first material and a neck part made of a second material in FIGS. 2A and 2B.

SUMMARY OF THE INVENTION

A usual head has a neck part as a joining portion of the head and a shaft. A shaft hole is formed in the neck part. In respect of securing the adhesion area of the head and the shaft, there is a limit to shorten the length of the neck part. The neck part is located on a heel side, and extends upward. Therefore, the mass of the neck part is apt to cause deviation of the position of the center of gravity of the head to the heel side. The mass existing in the upper part of the neck part may inhibit the lowering of the center of gravity.

It is an object of the present invention to provide a golf club head which can suppress maldistribution of a center of gravity of the head to a heel side and which can lower the center of gravity.

A golf club head according to the present invention includes a head body and a neck part. The head body and the neck part are joined. The head body has a body side joint surface and a first recessed part opened in the body side joint surface. A space is formed by the first recessed part. The neck part has a neck side joint surface brought into surface contact with the body side joint surface and a shaft hole. An abutted boundary surface determined by the surface contact passes through a vicinity of a head height lowest point. A plane perpendicular to an axis line of the shaft hole is defined as PL, and an angle between the plane PL and the abutted boundary surface is defined as θ degree. The angle θ when being viewed from a back side of the head is defined as plus in the case where a direction toward the abutted boundary surface from the plane PL is a counterclockwise rotation. The angle θ when being viewed from the back side of the head is defined as minus in the case where the direction toward the abutted boundary surface from the plane PL is a clockwise rotation. The angle θ is a plus value. The opening of the first recessed part is closed by the neck part.

Preferably, a volume center point of the space is located an upper side of a center of gravity of the head.

Preferably, the angle θ is +10 degrees or greater and +90 degrees or less.

Preferably, a projection part X is provided on any one of the body side joint surface and the neck side joint surface, and a second recessed part into which the projection part X is fitted is provided on the other.

A projection part Y may be provided on the neck side joint surface. Preferably, the projection part Y is fitted into the first recessed part. Preferably, the space is provided between a tip of the projection part Y and a bottom part of the first recessed part.

Preferably, a center line of the space extends upward toward a toe side.

Preferably, the head body and the neck part are joined by welding. Preferably, a welding bead exists between the head body and the neck part. Preferably, the welding bead is provided around the body side joint surface and the neck side joint surface.

The maldistribution of the center of gravity of the head on the heel side can be suppressed and lowering the center of gravity can be achieved.

DESCRIPTION OF THE PREFERRED EMBODIMENTS

Hereinafter, the present invention will be described in detail based on the preferred embodiments with appropriate references to the accompanying drawings.

Figure 1:
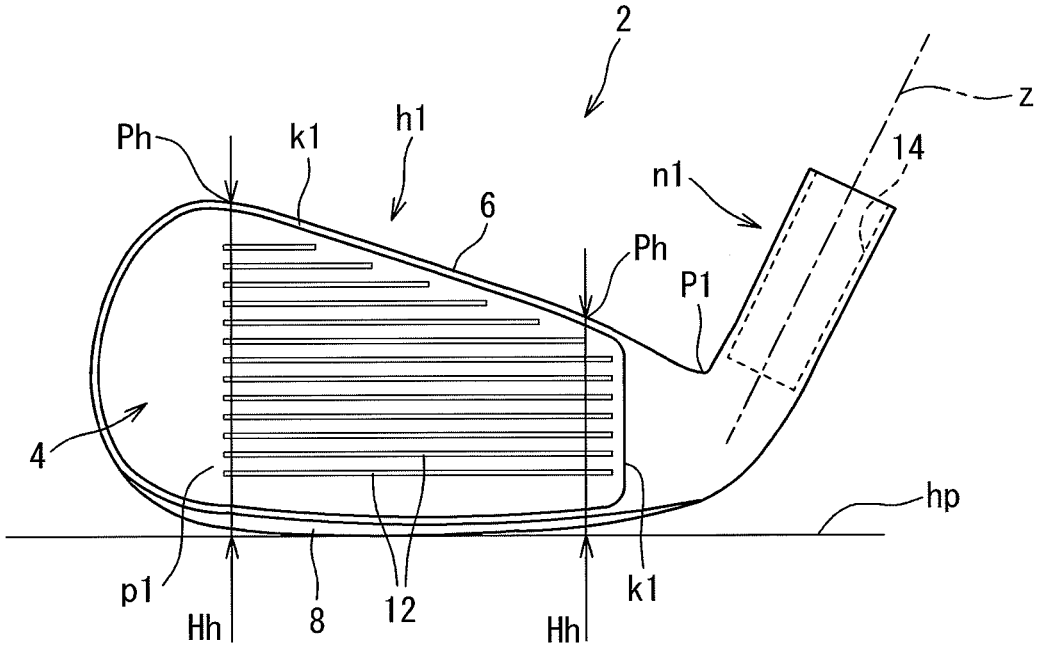
FIG. 1 is a front view of a head in a base state.
Figure 2:
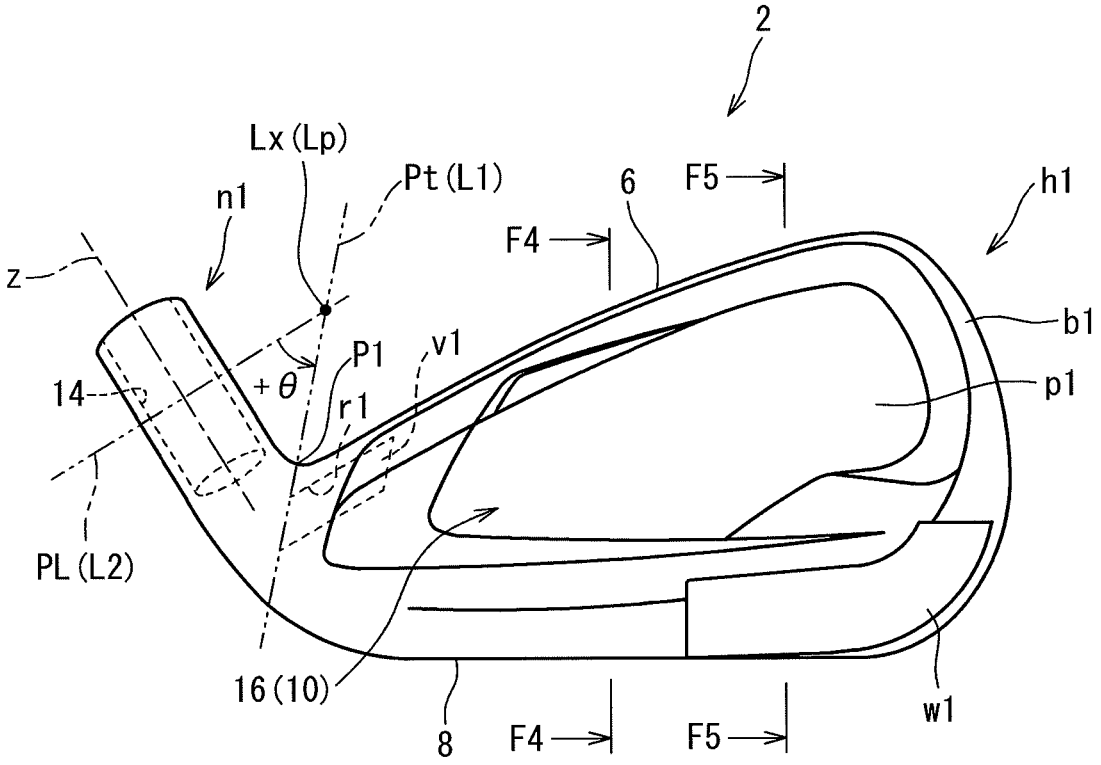
FIG. 2 is a back view of the head of FIG. 1.
Figure 3:
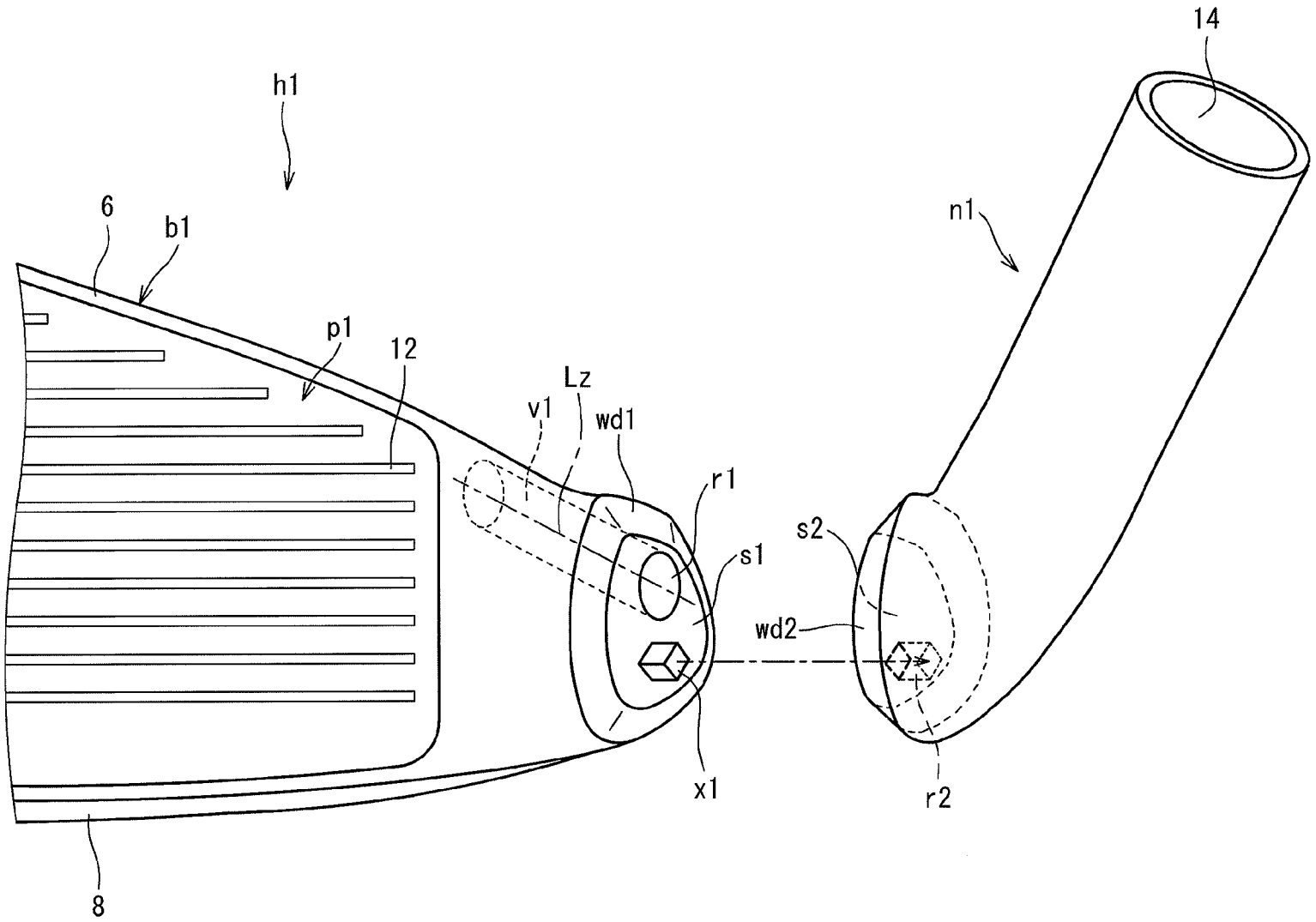
FIG. 3 is an exploded perspective view of the head of FIG. 1.
Figure 4:
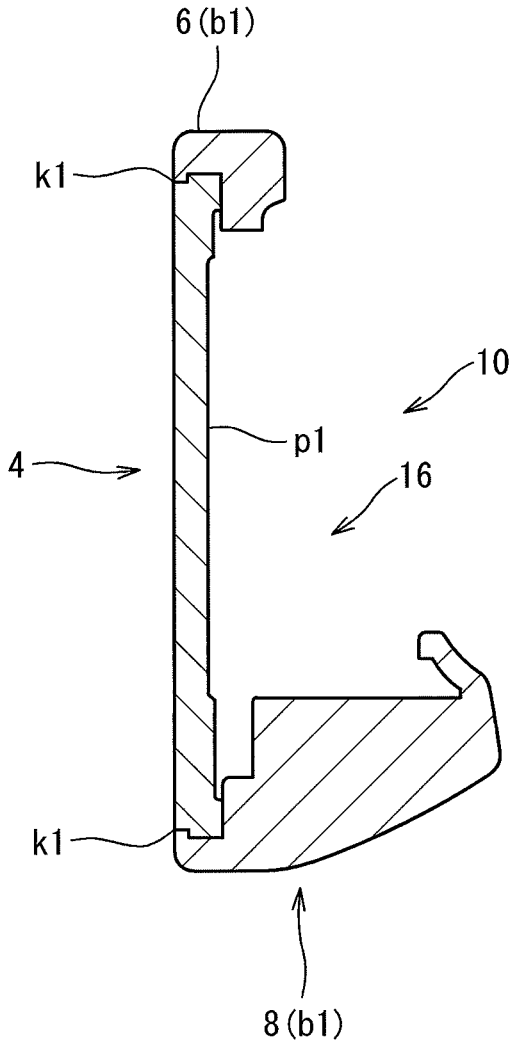
FIG. 4 is a cross-sectional view taken along line F4-F4 of FIG. 2.
Figure 5:
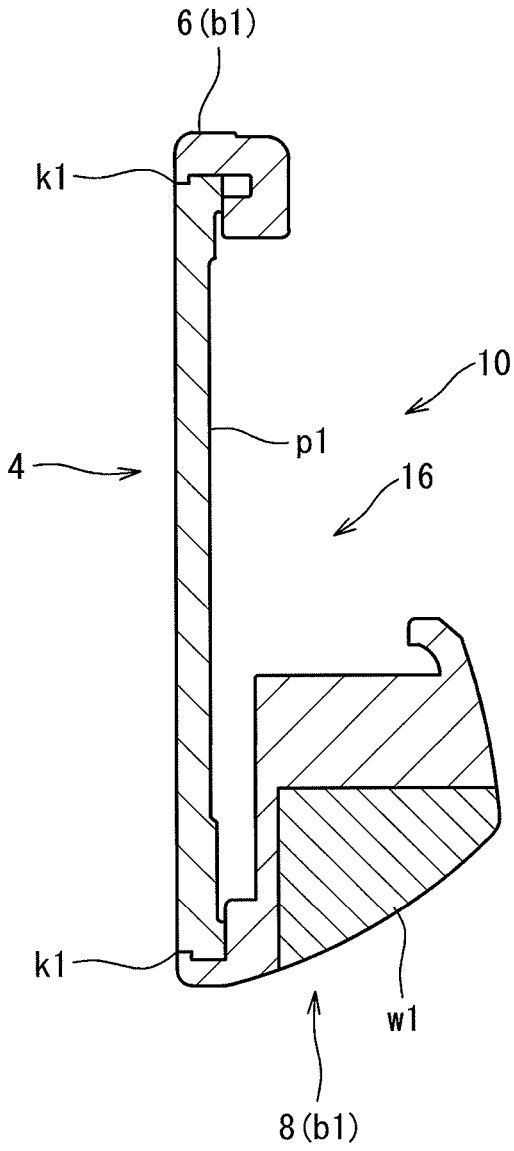
FIG. 5 is a cross-sectional view taken along line F5-F5 of FIG. 2.

FIG. 1 is a front view of a golf club head 2 according to an embodiment of the present invention. FIG. 2 is a back view of the head 2. FIG. 3 is an exploded perspective view of the head 2. FIG. 4 is a cross-sectional view taken along line F4-F4 of FIG. 2. FIG. 5 is a cross-sectional view taken along line F5-F5 of FIG. 2.

The head 2 includes a head body h1 and a neck part n1. The head body h1 and the neck part n1 are separately formed. The head body h1 and the neck part n1 are joined. A joining method is welding. The head body h1 and the neck part n1 are made of a material capable of being welded to each other. In respect of a weld strength, for example, both the head body h1 and the neck part n1 are preferably made of an iron-based metal. The iron-based metal means a metal containing 50% by mass or greater of iron. For example, both the head body h1 and the neck part n1 may be made of a titanium alloy. In respect of enhancing the lateral moment of inertia of the head, the specific gravity of the neck part n1 is preferably greater than that of a body b1 to be hereinafter described. In this respect, the body b1 is preferably made of stainless steel, and the neck part n1 is preferably made of a tungsten-nickel alloy capable of being welded to the stainless steel. In respect of the weld strength, the body b1 is preferably made of SUS630, and the neck part n1 is preferably made of a tungsten-nickel alloy capable of being welded to SUS630. In respect of enhancing the lateral moment of inertia of the head, the specific gravity of the neck part n1 is preferably greater than the average specific gravity of the head body h1. The details of the head body h1 and the body b1 will be described later.

In respect of increasing a moment of inertia, a difference between the specific gravity of the body b1 and the specific gravity of the neck part n1 is preferably equal to or greater than 1.0, and more preferably equal to or greater than 1.5. When a material having a strength required for the neck part n1 is considered, there is a limit to increase the specific gravity of the neck part n1. In this respect, the difference between the specific gravity of the body b1 and the specific gravity of the neck part n1 is preferably equal to or less than 3.0. In Examples to be described later, the difference between the specific gravity of the body b1 and the specific gravity of the neck part n1 is set to 1.7.

The head body h1 has a face surface 4, a top blade 6, a sole surface 8, and a back surface 10. The face surface 4 has score line grooves 12. Except for the score line grooves 12, the face surface 4 is substantially a plane. The face surface 4 may be a curved surface.

The neck part n1 has a shaft hole 14.

The head body h1 is obtained by combining a plurality of members. The members constituting the head body h1 are a face plate p1, the body b1, and a weight member w1. The face plate p1 and the body b1 are joined. An opening corresponding to the shape of the face plate p1 is formed in the body b1. The face plate p1 is fitted into the opening (see FIGS. 4 and 5). In FIG. 1, a boundary line k1 of the face plate p1 and the opening is illustrated. In respect of increasing the moment of inertia of the head 2, the specific gravity of the face plate p1 may be smaller than the specific gravity of the body b1.

The weight member w1 is disposed on the sole side of the body b1 on the toe side thereof. The weight member w1 constitutes a part of the sole surface 8. The weight member w1 constitutes a part of the back surface 10. The specific gravity of the weight member w1 is greater than the specific gravity of the body b1. The specific gravity of the weight member w1 may be greater than the specific gravity of the neck part n1. In respects of increasing the moment of inertia, lowering the center of gravity, and raising the center of gravity of a toe, a difference between the specific gravity of the body b1 and the specific gravity of the weight member w1 is preferably equal to or greater than 1.0, and more preferably equal to or greater than 1.5. When an available material is considered, there is a limit to increase the specific gravity of the weight member w1. In this respect, the difference between the specific gravity of the body b1 and the specific gravity of the weight member w1 is preferably equal to or less than 3.0. In Examples to be described later, the difference between the specific gravity of the body b1 and the specific gravity of the weight member w1 is set to 1.7.

The center of gravity of the weight member w1 is located on the toe side of the center of gravity of the head 2. The center of gravity of the weight member w1 is located on a lower side of the center of gravity of the head 2. Examples of the material of the weight member w1 include a tungsten alloy and a tungsten-nickel alloy.

A cavity part 16 is provided on the back surface 10. The cavity part 16 is provided on the back side of the face surface 4. The iron type head 2 having the cavity part 16 is generally referred to as a cavity back iron. The face plate p1 constitutes the bottom surface of the cavity part 16. That is, the face plate p1 has a portion having no backup. The constitution contributes to distribute the mass to the circumference, and contributes to increase the moment of inertia of the head 2.

As shown in FIG. 3, the head body h1 has a body side joint surface s1 and a first recessed part r1. In the embodiment, the body side joint surface s1 is a plane. The first recessed part r1 has an opening formed in the body side joint surface s1. In the embodiment, the first recessed part r1 is a hole. In the embodiment, the first recessed part r1 has a circular cross-sectional shape.

Furthermore, the body side joint surface s1 has a projection part x1. The projection part x1 has a non-circular cross-sectional shape. The projection part x1 has a polygon cross-sectional shape. The projection part x1 has a rectangle cross-sectional shape.

As shown in FIG. 3, the neck part n1 has a neck side joint surface s2. In the embodiment, the neck side joint surface s2 is a plane.

Furthermore, the neck side joint surface s2 has a second recessed part r2. The second recessed part r2 has an opening formed in the neck side joint surface s2. The shape of the second recessed part r2 corresponds to the shape of the projection part x1. In the head 2, the projection part x1 is fitted into the second recessed part r2 (see an arrow represented by a dashed dotted line in FIG. 3).

The projection part x1 has a non-circular cross-sectional shape. The second recessed part r2 has a non-circular cross-sectional shape. When the projection part x1 is fitted into the second recessed part r2, the relative rotation of the neck part n1 and the head body h1 is not enabled. When the projection part x1 is fitted into the second recessed part r2, the relative position of the neck part n1 and the head body h1 is fixed. The projection part x1 and the second recessed part r2 play a role of positioning the neck part n1 to the head body h1. The positioning facilitates the welding work of the head body h1 and the neck part n1.

A body side gap forming surface wd1 is provided around the body side joint surface s1. The body side gap forming surface wd1 may be partially provided around the body side joint surface s1. In the embodiment, the body side gap forming surface wd1 is wholly provided around the body side joint surface s1.

A neck side gap forming surface wd2 is provided around the neck side joint surface s2. The neck side gap forming surface wd2 may be partially provided around the neck side joint surface s2. In the embodiment, the neck side gap forming surface wd2 is wholly provided around the neck side joint surface s2.

The body side gap forming surface wd1 and the neck side gap forming surface wd2 contribute to improve the weld strength. The detail of the point will be described later.

DEFINITIONS OF TERMS

Herein, in respect of clarifying the invention described in the present application, terms used in the present application are defined as described later.

[Base State]

A base state is in a state where the head 2 is placed on a level surface hp at a predetermined lie angle and real loft angle. In the base state, a vertical plane VP1 (not shown) perpendicular to the level surface hp is considered. In the base state, an axis line z of the shaft hole 14 of the head 2 is provided in the vertical plane VP1. In the base state, the axis line z is inclined to the level surface hp at the lie angle. In the base state, the face surface is inclined to the plane VP1 at the real loft angle. In the base state, a sole of the head is grounded on the level surface hp. The predetermined lie angle and real loft angle are described in, for example, a product catalog. FIG. 1 shows the head 2 in the base state.

[Toe-Heel Direction]

In the head 2 in the base state, a direction parallel to an intersection line between the plane VP1 and the level surface hp is a toe-heel direction. A "toe side" and a "heel side" used in the present application are set based on the toe-heel direction.

[Vertical Direction]

In the head 2 in the base state, a direction of a straight line perpendicular to the level surface hp is defined as a vertical direction. An "upper side" and a "lower side" used in the present application are set based on the vertical direction.

[Face-Back Direction]

In the head 2 in the base state, a direction perpendicular to the toe-heel direction and perpendicular to the vertical direction is defined as a face-back direction. A "face side" and "a back side" used in the present application are set based on the face-back direction.

[Head Height Hh]

A vertical height of the head 2 in the base state is defined as a head height Hh (see FIG. 1). The head height Hh is set at all positions in the toe-heel direction. The head height Hh is a vertical distance between an uppermost point Ph and the level surface hp at each position in the toe-heel direction of the head. The point Ph is also set at all the positions in the toe-heel direction.

[Head Height Lowest Point P1]

In the head 2 in the base state, a lowermost point of the points Ph is a head height lowest point P1 (see FIG. 1). A toe side tip part of the head is excluded from the selection of the head height lowest point P1. An object for the selection of the head height lowest point P1 is a portion located on the heel side of a center point of the face surface.

[Vicinity ad1 of Head Height Lowest Point]

A point separated by 5 mm on the toe side from the head height lowest point P1 among the points Ph is defined as Pt5. A point separated by 5 mm on the heel side from the head height lowest point P1 among the points Ph is defined as Ph5 (see FIG. 6). A "vicinity ad1 of a head height lowest point" are points from the point Pt5 to the point Ph5 among the points Ph.

A more preferable vicinity ad1 of the head height lowest point is as follows. A point separated by 5 mm on the toe side from the head height lowest point P1 among the points Ph is defined as Pt5. A point separated by 3 mm on the heel side from the head height lowest point P1 among the points Ph is defined as Ph3 (see FIG. 6). A preferable "vicinity ad1 of a head height lowest point" are points from the point Pt5 to the point Ph3 among the points Ph.

[Abutted Boundary Surface]

A contact surface s12 (not shown) at which the body side joint surface s1 and the neck side joint surface s2 are brought into surface contact and an extended surface of the contact surface s12 are an abutted boundary surface Pt (see FIG. 2). In the embodiment, the body side joint surface s1 is a plane; the neck side joint surface s2 is also a plane; and the contact surface s12 is also a plane. Therefore, the abutted boundary surface Pt is also a plane. In FIG. 2, the plane Pt is simplified, and is represented by a straight line.

When the contact surface s12 is not a plane, the abutted boundary surface Pt is defined as follows.

(Definition 1) When an outline Lc of the contact surface s12 is on the same plane Px, the plane Px is defined as the abutted boundary surface Pt.

(Definition 2) A perpendicular plane Mp formed by a set of perpendicular lines taken down to a plane Py from points on the outline Lc is considered. The plane Py when the area of the perpendicular plane Mp is minimized in all the planes Py is defined as a plane Py1. At this time, the plane Py1 is defined as the abutted boundary surface Pt. When the plane Px exists, the area of the perpendicular plane Mp is zero, and the plane Px coincides with the plane Py1.

[Angle θ]

An angle between a plane PL and the abutted boundary surface Pt is θ (degree). The plane PL is a plane perpendicular to the axis line z of the shaft hole 14. In other words, the axis line z is a normal line of the plane PL. In FIG. 2, the plane PL is simplified, and is represented by a straight line.

[Projection Part X]

In the present application, different "projection parts" exist. In order to distinguish these projection parts in the wording, the term "projection part X" and the term "projection part Y" are used in the present application. The projection part X is provided on any one of the body side joint surface s1 and the neck side joint surface s2. The projection part X is fitted into the second recessed part r2. The projection part x1 is an example of the projection part X. The projection part X may be provided on the neck side joint surface s2. In this case, the second recessed part r2 is provided on the body side joint surface s1.

[Projection Part Y]

The projection part Y is a projection part different from the projection part X. The projection part Y is provided on the neck side joint surface s2. The projection part Y is fitted into the first recessed part r1. The fitting can attain the positioning of the neck part n1 to the head body h1. Since the positioning at two places is attained by the projection part X and the projection part Y, positioning accuracy can be improved. Positional displacement during welding work can be suppressed by the positioning at two places. In the embodiment, the projection part Y is not provided.

[Center Line of Space v1]

In the head 2 in the base state, a plane Pc (not shown) parallel to the face-back direction and parallel to the vertical direction is considered. The plane Pc is set at all positions in the toe-heel direction. An intersection line Lv (not shown) between the inner surface of the space v1 and the plane Pc is considered. A centroid Zc (not shown) of the intersection line Lv is determined. The centroid Zc is set at each position in the toe-heel direction. A set of the centroid Zc is defined as a "center line" in the present application. The center line may be broken in mid course. The center line Lz is represented by a dashed dotted line in FIG. 3.

[Plus and Minus of Angle θ]

Plus (+) and minus (−) are defined for the angle θ. The plus and the minus are determined by viewing the head from the back side. When a direction toward the abutted boundary surface Pt from the plane PL is a counterclockwise rotation, the angle θ is defined as plus. When a direction toward the abutted boundary surface from the plane PL is a clockwise rotation, the angle θ is defined as minus. In FIG. 2, the angle θ is plus.

When the head in the base state is viewed from the back side, the angle θ is an angle located on a lower side of the plane PL, and is an angle located on the heel side of the abutted boundary surface Pt. Therefore, in the embodiment of FIG. 2, the angle θ is an acute angle and is not an obtuse angle.

The angle θ is an angle between planes crossing to each other. That is, an intersection line between the abutted boundary surface Pt and the plane PL is defined as Lx. Any of points located on the intersection line Lx is set as Lp. A straight line passing through the point Lp, being perpendicular to the intersection line Lx, and located on the abutted boundary surface Pt is defined as L1. A straight line passing through the point Lp, being perpendicular to the intersection line Lx, and located on the plane PL is defined as L2. In this time, the angle θ is an angle between the straight line L1 and the straight line L2 (see FIG. 2). The definition for plus and minus of the angle θ is as follows in other words. When a direction toward the straight line L1 from the straight line L2 is a counterclockwise rotation as viewed from the back side of the head, the angle θ is defined as plus. When a direction toward the straight line L1 from the straight line L2 is a clockwise rotation, the angle θ is defined as minus. The angle θ is an angle located on a lower side of the straight line L2, and is an angle θ located on the heel side of the straight line L1.

[Volume Center Point]

In the present application, the term "volume center point" is defined for the space v1 formed by the first recessed part r1. When a case where the space v1 is completely filled with a filling body having constant density is assumed, the center of gravity of the filling body is defined as the volume center point of the space v1.

In the embodiment, the abutted boundary surface Pt is located between the cavity part 16 and the shaft hole 14. In the embodiment, the abutted boundary surface Pt passes through the vicinity ad1 of the head height lowest point. Therefore, the space v1 can be disposed near the neck part n1. The mass decreased by the space v1 can be distributed to the toe side. The mass distribution suppresses the deviation of the center of gravity of the head to the heel side.

In the embodiment, the space v1 extends along the top blade 6. The center line Lz of the space v1 extends upward toward the toe side. The center line Lz extends upward toward the toe side in the whole center line Lz. The space v1 tends to be disposed on the upper side of the head by the extending direction. The extending direction contributes to lower the center of gravity of the head. The space v1 may extend in a direction perpendicular to the body side joint surface s1.

In the embodiment, the angle θ is set to plus. Therefore, a direction perpendicular to the body side joint surface s1 is made closer to a direction extending upward toward the toe side. Therefore, the constitution in which the center line Lz of the space v1 extends upward toward the toe side can be facilitated. The extending direction can contribute to lower the center of gravity of the head. A distance between the shaft hole 14 and the abutted boundary surface Pt can be increased by setting the angle θ to plus. When a portion between the shaft hole 14 and the abutted boundary surface Pt is excessively thin, the strength may be reduced. The excessively thin portion is hardly generated by setting the angle θ to plus as described above.

The opening of the first recessed part r1 is closed by the neck part n1. In the embodiment, the opening of the first recessed part r1 is closed by the neck side joint surface s2. The first recessed part r1 is not visually recognized from the outside. Therefore, the appearance of the head 2 is improved. The intrusion of foreign matters into the space v1 is prevented.

The opening of the first recessed part r1 may be closed by the projection part Y described above.

Although not shown in the drawings, the space v1 is preferably provided between the tip of the projection part Y and the bottom part of the space v1 when the projection part Y is provided on the neck side joint surface s2. That is, even in a state where the projection part Y is fitted, the space v1 is preferably left. In this case, a positioning effect caused by the projection part Y and a moving effect of the position of the center of gravity of the head caused by the space v1 can be attained.

In the embodiment, the volume center point of the space v1 is located on the upper side of the center of gravity of the head. Therefore, the lowering of the center of gravity of the head is attained. In respect of lowering the center of gravity, the whole space v1 is more preferably located on the upper side of the center of gravity of the head.

Figure 6:
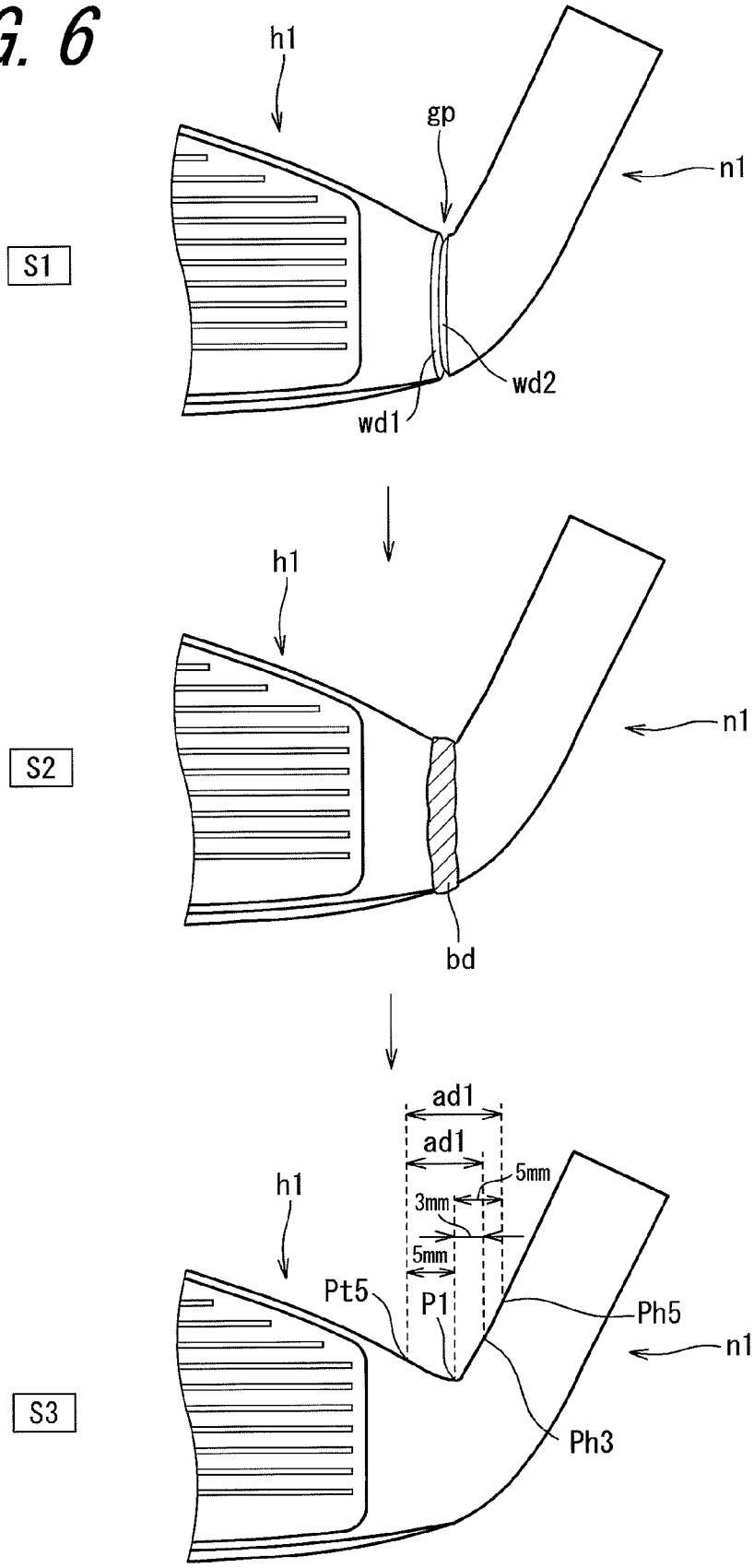
FIG. 6 is a process chart showing an example of a method for joining a head body and a neck part.

FIG. 6 shows an example of a step for joining the neck part n1 and the head body h1. In the joining step, first, the projection part x1 is fitted into the second recessed part r2 to form an abutted state S1 where the body side joint surface s1 and the neck side joint surface s2 are brought into surface contact with each other. In the abutted state S1, the neck part n1 is positioned to the head body h1.

A gap gp is formed in the abutted state S1. The gap gp exists between the body side gap forming surface wd1 and the neck side gap forming surface wd2. The body side gap forming surface wd1 has a shape such that the gap gp is generated between the body side gap forming surface wd1 and the neck part n1. The neck side gap forming surface wd2 has a shape such that the gap gp is generated between the neck side gap forming surface wd2 and the head body h1. When the body side gap forming surface wd1 is provided, the neck side gap forming surface wd2 may not be provided. On the other hand, when the neck side gap forming surface wd2 is provided, the body side gap forming surface wd1 may not be provided. When any one of the forming surfaces wd1 and wd2 exists, the gap gp is formed. In the embodiment, since the body side gap forming surface wd1 and the neck side gap forming surface wd2 are provided, the gap gp is large.

Next, the gap gp formed in the abutted state S1 is filled with a welding bead bd to form a bead filling state S2. The welding bead bd is shown by hatching in FIG. 6. The welding bead bd is formed by a well-known welding method. In the bead filling state S2, the gap gp is filled with the welding bead bd. Furthermore, the welding bead bd protruded from the gap gp exists. Although not shown in the drawings, at least a part of the body side gap forming surface wd1 is fused to the welding bead bd. Although not shown in the drawings, at least a part of the neck side gap forming surface wd2 is fused to the welding bead bd.

Next, the welding bead bd protruded from the gap gp in the bead filling state S2 is removed to form a finishing state S3. The removal is performed by polishing, for example. The welding bead bd is removed so that the surface of the neck part n1 and the surface of the head body h1 are smoothly continuous with each other. The gap gp is filled with the welding bead bd in the finishing state S3. The welding bead bd is certainly left by the gap gp. The gap gp enhances the joining strength of the neck part n1 and the head body h1. In particular, in the embodiment, the welding bead bd with which the gap gp is filled wholly exists around the body side joint surface s1 and the neck side joint surface s2. Therefore, the joining strength is further enhanced.

Preferably, the angle θ is set to plus. The angle facilitates the orientation of the center line Lz of the space v1 as described above. This tends to attain the lowering of the center of gravity. A distance between the bottom surface of the shaft hole 14 and the abutted boundary surface Pt tends to be increased by making the angle θ larger. This can prevent the excessively thin portion from being formed between the shaft hole 14 and the abutted boundary surface Pt. Furthermore, the cross-section area of the head 2 by the abutted boundary surface Pt tends to be increased by making the angle θ larger. This tends to increase the joined area of the head body h1 and the neck part n1. In these respects, the angle θ is preferably equal to or greater than +10 degrees, more preferably equal to or greater than +20 degrees, and still more preferably equal to or greater than +30 degrees. On the other hand, when the angle is excessive, the center line Lz may be hardly oriented as described above. When the angle θ is excessive, the abutted boundary surface Pt is closer to a cavity 16 of the head. In this case, the shape of the body side joint surface s1 or the vicinity thereof may become complicated. The complicated shape may make welding or finishing polishing difficult. In these respects, the angle θ is preferably equal to or less than +90 degrees, more preferably equal to or less than +70 degrees, and still more preferably equal to or less than +50 degrees.

When the abutted boundary surface Pt passes through the heel side of the vicinity ad1 of the head height lowest point, the abutted boundary surface Pt is closer to the bottom of the shaft hole 14. Thereby, the excessively thin portion (thin-walled part) may be generated near the bottom part of the shaft hole 14. The thin-walled part may reduce the strength of the head 2. When the length of the shaft hole 14 is shortened in order to avoid the thin-walled part, the adhesion area of the shaft and shaft hole 14 is reduced. In these respects, the abutted boundary surface Pt preferably passes through the vicinity ad1 of the head height lowest point.

When the abutted boundary surface Pt passes through the toe side of the vicinity ad1 of the head height lowest point, the volume of the space v1 is apt to be reduced. This can decrease the moving effect of the center of gravity caused by the space v1. In this respect, the abutted boundary surface Pt preferably passes through the vicinity ad1 of the head height lowest point.

Preferably, the method for joining the head 2 includes the following steps:

(a) The projection part X is fitted into the second recessed part r2 to form the abutted state S1 where the body side joint surface s1 and the neck side joint surface s2 are brought into surface contact with each other;

(b) In the abutted state S1, a real loft angle, a lie angle, and/or a face angle are/is measured;

(c) When the measurement result is deviated from a predetermined reference value, the real loft angle, the lie angle, and/or the face angle are/is adjusted so that the measurement result is within the reference value; and (d) The head body h1 and the neck part n1 are welded in a state where the real loft angle, the lie angle, and/or the face angle satisfy/satisfies the reference value.

These steps enhance the accuracy of the real loft angle, the lie angle, and/or the face angle. In the case of a head made of a material (for example, titanium alloy) toughening so-called angle adjustment, it is difficult to correct the real loft angle, the lie angle, and/or the face angle. However, the steps can solve the problem.

In respect of enabling the adjustment of the step (c), the projection part X and/or the second recessed part r2 may have a circular cross-sectional shape. In this case, the adjustment (particularly, the adjustment of the real loft angle) in the step (c) can be facilitated.

The adjustment of the step (c) preferably involves the relative rotation of the projection part X and the second recessed part r2. In this case, the adjustment can be facilitated.

The adjustment in the adjusting step of the step (c) is preferably performed while the abutted state S1 where the body side joint surface s1 and the neck side joint surface s2 are brought into surface contact with each other is maintained. In this case, the joining strength of the head body h1 and the neck part n1 can be maintained.

Preferably, the real loft angle is adjusted in the adjusting step of the step (c). When the head body h1 is rotated to the neck part n1 while the abutted state S1 is maintained in the embodiment, the real loft angle can be easily changed.

The projection part X may be force-fitted into the second recessed part r2. The force-fitting means that a pressing force is required to insert the projection part X into the second recessed part r2. The force-fitting puts a restraint on the relative rotation of the projection part X and the second recessed part r2. The force-fitting ensures the fixation of the neck part n1 to the head body h1 to enhance the positioning accuracy. Therefore, the positional displacement during welding is suppressed to enhance the accuracy of the real loft angle, the lie angle, and/or the face angle.

EXAMPLES

Hereinafter, the effects of the present invention will be clarified by examples. However, the present invention should not be interpreted in a limited way based on the description of examples.

A head having the same structure as that of the head 2 was produced. A body of the head was produced by a lost-wax precision casting method. A first recessed part r1 was formed by casting. The material of the body was SUS630. The material of a face plate was a titanium alloy "51AF" manufactured by Nippon Steel Corporation. A neck part was produced by the lost-wax precision casting method. The material of the neck part was a tungsten-nickel alloy. A weight member was produced by the lost-wax precision casting method. The material of the weight member was a tungsten-nickel alloy. The neck part was welded to the head body by the method described using FIG. 6 to obtain the head. In the head, the first recessed part was closed by a neck side joint surface, and a space v1 having a large volume was formed in the upper part of the head. The space v1 was a hollow part, and could not be visually recognized from the outside. Therefore, the head having excellent appearance could be produced.

Since the specific gravity of the neck part n1 was large in this Example, weight dispersion in a toe-heel direction was attained. For this reason, a large moment of inertia was obtained. The first recessed part r1 was provided. Thereby, although the specific gravity of the neck part n1 was large, the deviation of the center of gravity of the head to the heel side was suppressed and the lowering of the center of gravity was attained.

The invention described above can be applied to all golf club heads such as a wood type golf club head, a hybrid type golf club head, a utility type golf club head, an iron type golf club head, and a putter type golf club head.

The description hereinabove is merely for an illustrative example, and various modifications can be made in the scope not to depart from the principles of the present invention.

What is claimed is:

1. A golf club head comprising:

a head body; and a neck part, wherein the neck part is welded to the head body;

the head body has a body side joint surface and a first recessed part opened in the body side joint surface;

a space is formed by the first recessed part, wherein the whole space is located on an upper side of a center of gravity of the head;

the neck part has a neck side joint surface brought into surface contact with the body side joint surface and a shaft hole;

an abutted boundary surface determined by the surface contact passes through a vicinity of a head height lowest point; and when a plane perpendicular to an axis line of the shaft hole is defined as PL, and an angle between the plane PL and the abutted boundary surface is defined as θ degree; the angle θ when being viewed from a back side of the head is defined as plus in the case where a direction toward the abutted boundary surface from the plane PL is a counterclockwise rotation; and the angle θ when being viewed from the back side of the head is defined as minus in the case where the direction toward the abutted boundary surface from the plane PL is a clockwise rotation, whereby the above defined angle θ is a plus value, and the opening of the first recessed part is closed by the neck part.

2. The golf club head according to claim 1, wherein the angle θ is plus 10 degrees or greater and plus 90 degrees or less.

3. The golf club head according to claim 2, wherein the angle θ is plus 20 degrees or greater and plus 70 degrees or less.

4. The golf club head according to claim 3, wherein the angle θ is plus 30 degrees or greater and plus 50 degrees or less.

5. The golf club head according to claim 1, wherein a projection part X is provided on any one of the body side joint surface and the neck side joint surface, and a second recessed part into which the projection part X is fitted is provided on the other.

6. The golf club head according to claim 5, wherein the projection part X has a non-circular cross-sectional shape.

7. The golf club head according to claim 6, wherein the projection part X has a polygon cross-sectional shape.

8. The golf club head according to claim 6, wherein the cross-sectional shape of the second recessed part corresponds to the cross-sectional shape of the projection part X.

9. The golf club head according to claim 5, wherein the projection part X and/or the second recessed part have/has a circular cross-sectional shape.

10. The golf club head according to claim 5, wherein the projection part X is force-fitted into the second recessed part.

11. The golf club head according to claim 1, wherein a projection part Y is provided on the neck side joint surface;

the projection part Y is fitted into the first recessed part; and the space is provided between a tip of the projection part Y and a bottom part of the first recessed part.

12. The golf club head according to claim 1, wherein a center line of the space extends upward toward a toe side.

13. The golf club head according to claim 1, wherein;

a welding bead exists between the head body and the neck part; and the welding bead is provided around the body side joint surface and the neck side joint surface.

14. The golf club head according to claim 1, wherein a specific gravity of the neck part is greater than an average specific gravity of the head body.

15. The golf club head according to claim 1, further comprising a weight member, and a center of gravity of the weight member is located on a toe side of a center of gravity of the head.

16. The golf club head according to claim 1, further comprising a weight member, and a center of gravity of the weight member is located on a lower side of a center of gravity of the head.

17. The golf club head according to claim 1, further comprising a top blade, and the space extends along the top blade.

18. The golf club head according to claim 1, wherein the golf club head satisfies the following item (a) and/or the following item (b):

(a) the head body further comprises a body side gap forming surface; and (b) the neck part further comprises a neck side gap forming surface;

a gap caused by the body side gap forming surface and/or the neck side gap forming surface exists in an abutted state where the body side joint surface and the neck side joint surface are brought into surface contact with each other; and the gap is filled with a welding bead.

* * * * *